US005722929A

United States Patent [19]

Smith et al.

[11] Patent Number: 5,722,929

[45] Date of Patent: *Mar. 3, 1998

[54] PARTICLE AGGLOMERATION WITH ACIDIC SULPHATE

[75] Inventors: Neil L. Smith, Oakville; Peter Ryan, Sudbury; Carey Mitchell, Garson, all of Canada

[73] Assignee: Southwind Enterprises Inc., Ontario, Canada

[ * ] Notice: The term of this patent shall not extend beyond the expiration date of Pat. No. 5,516,976.

[21] Appl. No.: 768,255

[22] Filed: Dec. 17, 1996

Related U.S. Application Data

[63] Continuation-in-part of Ser. No. 606,586, Feb. 26, 1996, which is a continuation of Ser. No. 295,056, Aug. 26, 1994, Pat. No. 5,516,976.

[51] Int. Cl.[6] ..... C22B 1/243

[52] U.S. Cl. ..... 588/257; 588/252; 75/747

[58] Field of Search ..... 75/747, 770, 773; 405/128, 129, 258; 588/249, 250, 252, 257

[56] References Cited

U.S. PATENT DOCUMENTS

| | | | |
|---|---|---|---|
| 1,990,948 | 2/1935 | Loghry . | |
| 3,789,097 | 1/1974 | Beck et al. | 75/768 |
| 3,850,613 | 11/1974 | Allen | 75/752 |
| 4,004,918 | 1/1977 | Fukuoka | 75/10.5 |
| 4,049,444 | 9/1977 | Bell et al. | 75/10.67 |
| 4,119,455 | 10/1978 | Cass et al. | 75/310 |
| 4,266,971 | 5/1981 | Schwartz et al. | 75/696 |
| 4,544,542 | 10/1985 | Angevine et al. | 423/555 |
| 4,659,374 | 4/1987 | Alanko et al. | 75/766 |
| 4,666,694 | 5/1987 | Jons et al. | 423/555 |
| 4,802,919 | 2/1989 | Fey . | |
| 5,100,464 | 3/1992 | Kelly et al. . | |
| 5,104,446 | 4/1992 | Keough et al. | 75/755 |
| 5,116,417 | 5/1992 | Walker et al. | 75/327 |
| 5,276,254 | 1/1994 | Breen et al. | 588/256 |
| 5,385,602 | 1/1995 | Keough et al. | 75/766 |
| 5,516,976 | 5/1996 | Smith et al. | 588/257 |

FOREIGN PATENT DOCUMENTS

| | | |
|---|---|---|
| 0 329 281 | 1/1989 | European Pat. Off. . |
| WO94/24317 | 10/1994 | WIPO . |

*Primary Examiner*—John A. Ricci
*Attorney, Agent, or Firm*—Bereskin & Parr

[57] ABSTRACT

An agglomeration process for metallurgical by-products and waste products is described, utilizing the sulphate material present in the metallurgical waste and by-products, which involves reacting the sulphate with water and optionally with an added alkaline earth metal compound. Sulphuric acid may also be added to the particles to be agglomerated. The obtained mixture is extruded or cast, and allowed to harden before being used in recycling to an extractive process. The agglomeration mechanism involves one or more of, hydration of a water soluble sulphate, precipitation of a water insoluble alkaline earth metal sulphate and hydration of a water insoluble sulphate.

32 Claims, No Drawings

PARTICLE AGGLOMERATION WITH ACIDIC SULPHATE

This application is a continuation-in-part of application Ser. No. 08/606,586 filed Feb. 26, 1996, which is a continuation of application Ser. No. 08/295,056 filed Aug. 26, 1994, Pat. No. 5,516,976.

FIELD OF THE INVENTION

This invention relates to agglomeration of particles, more particularly particles, which are to be recycled to extractive process stages in metallurgical operations, or for storage under environmentally acceptable conditions.

BACKGROUND TO THE INVENTION

There is a growing demand for methods which allow the recycling of particles such as dust, larger particles and pieces that contain extractable metal values, to processes for recovering such metal values. The dust and particles under consideration often include metallurgical feeds, products, by-products and waste products of various metallurgical refining, gas cleaning, metal working and various other metallurgy-related operations. A particularly metal rich by-product of certain metallurgical operations contains sulphates of value metals. The metal sulphates are often very fine and can be easily blown away by the updraught in the converter, furnace or other metallurgical extractive installation when attempts are made to feed or charge them to such installations. Thus there is a need for an inexpensive method for forming shape-retaining agglomerates of various particles.

Fine particles are in some instances to be stored, transported or may be intended to be used as backfill. The fine particles can easily be blown away by wind or draft and thus need to be agglomerated and anchored for environmental reasons.

Similarly, other metal particles are advantageously agglomerated before introduction into metallurgical processes. For example, scrap iron or steel may be reduced to fine particles and its introduction into furnaces is facilitated if the particles are first agglomerated. Similarly, dross or spillage usually break up into small particles and need to be agglomerated if these are to be recycled.

Some of the by-products and waste products of metallurgical processes contain sulphates, usually at least partially water soluble metal sulphates which may in the presence of water and other additives yield a reaction product which acts as an agglomerant.

It is to be noted that calcium sulphate is one of the products of several known processes which are particularly designed to capture and absorb sulphurous oxides contained in exhaust and flue gases in metallurgical processes. Such absorption is usually conducted by limestone, calcium and magnesium oxides and hydroxides, and carbonates, and similar alkali and alkaline earth metal containing adsorbents. The products of such processes are usually predominantly calcium sulphate, other metal sulphates are only present as impurities. In other words, conventional sulphurous gas absorbing processes yielding calcium sulphate and/or gypsum which may be agglomerated in a subsequent step, are not considered to be relevant to the products to be treated in the present process, nor to the discussion with respect to the operation and implementation of the present invention.

SUMMARY OF THE INVENTION

A process for agglomerating metallurgical particles including loose, metal sulphate containing particles is described to render the metallurgical particles suitable as feedstock in a metal extractive process, comprising mixing said metallurgical particles with water;

wherein said water is present in an amount to cause a substantial portion of said metal sulphate containing particles to react according to as least one reaction mechanism selected from the group consisting of hydration and precipitation of an alkaline earth metal sulphate, said alkaline earth metal selected from the group consisting of magnesium, calcium, strontium, and barium, thereby yielding a hardenable agglomerate. The agglomerate is subsequently extruded or cast in molds.

It is to be noted that although water soluble sulphates of group 1A, 2A and 3B metals are included in the above process steps, these metals are not normally recovered by conventional metal extractive processes. Group 1A, 2A and 3B metal sulphates may be present in small amounts without interfering with the products of the process or with the recovery of the value metals in the metal sulphate particles.

DETAILED DESCRIPTION OF THE PREFERRED EMBODIMENTS

As discussed above, this process is designed to obtain agglomerates for charging to one of the extractive metallurgical process steps for the recovery of the metal in the metal sulphate. The agglomerates obtained may also be utilized in transporting or in storage of the agglomerates and if appropriate, to be utilized in filling up mine cavities, a process generally known as mine backfill operation.

Metal sulphates are often present in by-products obtained in metallurgical operations and processes. One such by-product is the sediment and slime obtained and collected in the bottom of vats, tanks and similar containers in electrolytic refining steps. The sediment and slime often contains a significant portion of various metal sulphates in the shape of fine particles. The fine particles may be predominantly one kind of metal sulphate, such as for example, nickel sulphate produced as by-product in the electrolytic refining of copper or nickel, but more often the particles contain a mixture of metal sulphates, together with oxides deposited separately or as basic metal sulphates, and even fine particles of precious metals. When dried, such sulphates are usually in the form of very small sized particles, and are thus very difficult to handle.

Metal sulphates may also be present in dust collected by electrostatic precipitators, also known as Cottrell-dust, resulting from reaction of sulphurous gases with fine particles of oxides carried by the exhaust gases. Metal sulphates may also be present in fumes and waste-products of processes having different objectives.

Metal sulphates may occur in the waste products of photographic processes or in processes which utilize metal or metal oxides as catalysts.

Metal sulphates may also be found in sufficiently large quantities to render recovery economically feasible, in the residues of various leaching processes. Furthermore, any treatment of metals or metal compounds with sulphuric acid which results in metal sulphate formation, more particularly base metal sulphate formation, may yield a metal sulphate as a metal sulphate containing solid particle, which may then be recycled to metal recovery. Metals which are of particular interest to be recycled include nickel, copper, cobalt, silver, chromium, titanium, zinc and metals which are often referred to as transition metals. Value metal sulphates suitable for recovery may also be found in sludges obtained in various industrial processes.

The above are just a few of the more common processes which provide particles containing value metal sulphate which may be economically recoverable in a recycling operation. There may be many other sources for value metal sulphates which a skilled person would be familiar with.

Most of the above discussed metal sulphates are either fully or partially water soluble, but when dried may in part decompose to oxides, and in any case, are usually in the form of very small size such as 20 or 50 micron particles. As discussed above, such metal compound containing metal sulphate particles are too fine for charging to metal extractive process steps and need to be agglomerated by relatively inexpensive methods.

The sulphates of most base metals, with the exception of lead, are known to be water soluble. Thus, these sulphates can be used as the source of sulphate ions utilized in this process.

We have found that agglomeration of such metal sulphate containing particles may be carried out in the presence of water using one or more of several reactions. The reaction of water with such particles can result in the hydration of water soluble sulphate and lead to the formation of another solid compound. Another mechanism for agglomeration involves precipitation of a water insoluble alkaline earth metal sulphate. Furthermore, hydration of a water insoluble sulphate provides yet another mechanism for agglomeration. Accordingly, the process requires mixing of water with particulate matter containing loose, metal sulphate containing particles. The agglomeration of the particles occur as one or more of the above reaction mechanisms take place. Depending on the constituents in the starting particulate material and other additions to the mixture one or more of these mechanisms may predominate. However, it is considered that all three mechanisms may occur either simultaneously or consecutively as the mixing of the particles with water takes place.

Where the material to be agglomerated does not contain sulphates which can become available for the reaction disclosed herein then another source of sulphate ions must be provided. It may happen that the material to be agglomerated does not contain any sulphates or at least no sulphates which are water soluble, or the material may contain a water soluble sulphate but in insufficient quantity to form acceptable agglomerates. In this case sulphuric acid may be added to the material to be agglomerated to provide or increase the amount of sulphate required for acceptable agglomerates, alternatively or additionally, additional particulate matter containing water soluble sulphates may be added to the mixture to provide the desired sulphate level. The sulphate can be present as a wet solid such as acidic refinery slimes, sludges or residues or added directly as sulphuric acid containing liquid.

Favourable conditions for the mechanism yielding water insoluble sulphate often involves the addition of an alkaline earth metal compound. The alkaline earth metal compound may be added as lime, (CaO), slaked lime ($Ca(OH)_2$), dolime or hydrated dolime having the general formula:

$$xCaO.yMgO.aCa(OH)_2.bMg(OH)_2$$

wherein x, y, a and b can have any value including zero. Dolime is usually understood to have been obtained by calcining dolomites. Burnt dolomite or other alkaline earth metal oxide or hydroxide containing materials may also be used to provide the alkaline earth metal compound in the present process. For the sake of simplicity, in the discussion of the various aspects of the present process, the alkaline earth metal oxide or hydroxide containing compounds utilized will be referred to as lime containing compounds.

In one aspect of the process, the loose particles containing metal sulphate are mixed with lime containing compounds preferably also in the form of fine particles. Sufficient water is then added to the mixture of fine particles to make it into a thick paste. Excess water, that is such that results in the formation of a slurry, is to be avoided.

If convenient, the lime containing compound may be first made into a water containing thick slurry and then mixed with the particles to be agglomerated. The water content of the slurry of lime containing compounds, however, has to be carefully controlled and adjusted such that the resulting mixture of lime containing compounds and sulphate containing particles is a water bearing, thick, typically fairly damp mixture but no excess water is present as a separate liquid phase, as it is understood by a skilled technician.

In another aspect of the invention, agglomeration of particles originating as by-product or waste product of metallurgical processes is achieved by the sulphate present in the loose particles only and in the absence of added alkaline earth metal containing compounds. For best results a transition metal sulphate should be present in the particles in notable amounts. The amount of sulphate present in the particles in relation to the total weight of the parties to be agglomerated may not be estimated precisely as the particle size range, bulk density and similar properties of the particles will have a substantial bearing on the amount of agglomerant required. However, in accordance with this aspect of the invention, agglomeration of transition metal sulphate containing particles can be conducted by the addition of controlled amounts of water, such that resulting damp mixture does not contain water as a separate phase.

The reactions that may take place in the above aspects of the present invention, may be illustrated by the following equations:

Dealing first with the precipitation aspect, $$A(OH)_2+MSO_4 \rightarrow ASO_4+M(OH)_2, \quad 1$$

where A may be calcium, strontium, barium and magnesium and the resulting alkaline earth metal sulphate is water insoluble except in the case of magnesium sulphate; and M represents a multi-valent metal, most commonly di-valent, but it may be tri-or tetravalent, usually a transition metal, such as nickel, copper, cobalt and similar metals.

The resulting metal hydroxide, $M(OH)_2$ is usually water insoluble and may form an oxide and water according to the following equation:

$$M(OH)_2 \rightarrow MO+H_2O, \quad 2$$

leading to the formation of an oxide such as nickel oxide or cobalt oxide or copper oxide in a further reaction step.

Other reactions taking place in the present process are described by equations 3 and 4 as follows:

$$ASO_4+cH_2O \rightarrow ASO_4.cH_2O, \quad 3$$

where c is greater than zero, often having value of 2, such as $CaSO_4.2H_2O$, in the gypsum formation reaction.

$$MSO_4+dH_2O \rightarrow MSO_4.dH_2O \quad 4$$

where d is greater than zero and may have values as high as seven. A and M stand for metals as defined in equations 1 and 2.

The hydration reactions 3 and 4 may take place in stages. An example of reaction 3 is:

$$CaSO_4+\frac{1}{2}H_2O \rightarrow CaSO_4.\frac{1}{2}H_2O$$

and $$CaSO_4.\frac{1}{2}H_2O+\frac{3}{2}H_2O \rightarrow CaSO_4.2H_2O.$$

An example of reaction 4 is:

$$NiSO_4+2H_2O \rightarrow NiSO_4.2H_2O$$

and $$NiSO_4.2H_2O+4H_2O \rightarrow NiSO_4.6H_2O.$$

The precipitation of water insoluble sulphates as shown by equation 1 is a reaction that yields an agglomerant taking part in the process.

The hydration reactions depicted by equations 3 and 4 are recrystallization steps and it is hypothesized that the rearrangement of the solid crystalline phases present in the mixture is providing another binding mechanism in the agglomeration process of the present invention.

Thus, the above reactions fall into the category of either hydration of water soluble and/or water insoluble sulphates, or the precipitation of water insoluble sulphates. As stated above, any one or all the reactions may take place in the agglomeration process, furthermore, they may take place successively or simultaneously.

The mixture of wet particles may contain either inherently or by deliberate addition, free sulphuric acid, which then will also react with lime containing compounds, thus forming crystalline alkaline earth metal sulphates.

It can be seen that the presence of water is essential in the above reactions: in the hydration steps it is one of the reagents and in the precipitation step, water is the medium in which the precipitation may take place. However, as discussed above, care should be taken that water is not present as a separate phase in the final stage of the agglomeration step, that is, when extrusion takes place. The presence of excess water can easily lead to dissolution of the metal sulphate instead of recrystallization of the sulphates.

The above reactions, including the neutralization of the sulphuric acid if present, will generate heat, and hence loss of some of the water by evaporation should be taken into consideration when assessing or adjusting the required amount of water in the mixture. The water required in the agglomeration is usually less than 20 wt % based on the total weight of the mixture.

It is to be noted, that not all the sulphate present in the mixture is likely to take part in the agglomeration reactions. It is probable that the product of the agglomerating reactions that is, the resulting agglomerants will enclose particles of unreacted sulphates and as well as particles that do not contain sulphates.

Some of the metallurgical waste particles mixed with the sulphate containing waste particles may additionally contain alkaline earth metal compounds, in particular calcium containing compounds in which case gypsum formation may result without deliberate addition of alkaline earth metal compounds.

Furthermore, the particles of metallurgical by-product or waste products may also contain siliceous compounds that are capable of reacting with the admixed lime containing compounds, thus providing another agglomeration process step resulting in yet another agglomerant, namely, a cementitious compound.

The transition metal sulphates which can be utilized in the above agglomerating reactions include nickel sulphate, copper sulphate, cobalt sulphate, chromium sulphate, titanium sulphate, vanadium sulphate, iron sulphate, zinc sulphate and sulphates of similar metals.

The agglomerating reaction requiring sulphates and water only is particularly useful when a high purity product is required. Such may be the case when agglomeration of loose titanium sulphate particles or silver sulphate particles is desired. The resulting high purity agglomerates are utilized in other metallurgical processes. Similarly, a metallurgical by-product containing substantially nickel and copper sulphates may be agglomerated by the controlled addition of water and recycled to metal extractive process steps.

The wet mixture of sulphate containing metallurgical particles and lime containing compounds, or merely wet sulphate containing particles, are usually extruded to form larger irregularly shaped extrudates or pellets. Alternatively, the wet mixture may be cast into molds and allowed to solidify.

The thick mixture is extruded by conventional means. The extrusion step preferably immediately follows the mixing step. The size and shape of the extruded agglomerates is determined by convenience only. The extruded agglomerates or extrudates, may have diameters or cross-sectional dimensions ranging from a fraction of an inch to several inches.

It may be convenient to conduct the mixing of the components of the mixture and the extrusion in one installation, such as for example, an extrusion press, in a combined single step. This, however, is not mandatory, as long as the time interval between the mixing and the extrusion is not unduly long.

The extruded agglomerates are capable of shape retention and stockpiling, but are usually not yet hard. The extruded agglomerates obtain sufficient strength to be mechanically handled without dusting or breakage within 20 to 30 minutes. The extrudates will continue to cure over a period of days.

When feeding materials through an extrusion press, it appears that the best skeletal strength of the resulting extrusion is achieved when there is a variation of the coarseness of the particulate material. The best skeletal strength is achieved when the mixture is ⅓ coarse particles, ⅓ intermediate sized particles and ⅓ fine sized particles. We have found that if a material is very fine with all of the particles roughly the same size then a larger amount of binder will be required. It is hypothesized that this is because of the large surface area of the small particles which is required to be coated for good agglomeration.

While any size of agglomerate is possible depending upon the end use for the product resulting from this process and depending upon the extrusion equipment available, in keeping with usual extrusion techniques it is suggested that the maximum size of particle be handled in the extrusion press should be less than ½ of the maximum diameter of the dieplate. Utilization of particles larger than this opening in the dieplate may result in objectionable flow restriction through the dieplate.

Once the material has been extruded then it will take some time for the extrudates to obtain the final set. The reactions set out above are exothermic, that is, give off heat. Accordingly, the material will normally retain a slightly elevated temperature while the material continues to set. After the material has set it will then cool to ambient temperatures. The time for the material to obtain a final set will vary considerably depending upon the nature of the material. Typically however, it will take a period of several hours for the material to achieve a final set and hardness.

We have noted that addition of auxiliary heat after the product leaves the extrusion press can considerably shorten the time to achieve the final set. Various sources of thermal energy may be utilized to speed up the set. We contemplate use of all of the low frequency electromagnetic radiation types below visible light. This includes baking by using radio wave radiation, microwave radiation, infrared radiation, and convection. The use of such auxiliary heating following the extrusion step is particularly useful in operations done on a commercial scale. If product must be allowed to achieve final set over a period of a number of hours then the product must be effectively stored for that time. Only after the product has achieved its final set can it be handled roughly without some dusting occurring. This means that substantial floor space or storage must be provided for the extrusion product to achieve final set. By using alternative energy and in particular, microwave energy, the product appears to achieve final set in a very shortened time frame. It appears that final set can be achieved in only a few minutes. This in turn permits the material from the extruder press to be conveniently place on a conveyor belt which passes under a source of microwave energy. The microwave appears to accelerate the reactions discussed above. Because the microwave energy penetrates the extrudates so formed, there is curing not just at the surface of the extrudate but throughout the entire volume of the extrudate.

It has been observed that even though additional energy is applied to extrudates as explained above, the extrudates return more quickly to ambient temperature. It is hypothesized that the return to ambient temperature occurs quickly because the reactions have been allowed to proceed to completion and thus there is no further heat energy given off. Thus, material can be removed directly from the drying conveyor and be placed in storage bags and the like for shipment to the facility in which the materials are to be recycled to processing or stored.

It is noted, however, that heating or addition of heat energy to the product to achieve faster setting takes place after extrusion, that is the present process is different from conventional briquetting.

EXAMPLES 1–5

Nickel sulphate containing material, which was the waste product of an electro refining process step, was mixed with water and agglomerated with or without the addition of an alkaline earth metal compound. The mixture was extruded and then was allowed to harden for 12 to 24 hours then tested for hardness and shape retention by drop tests. The hardened product was subjected to X-ray diffraction analysis.

The nickel sulphate containing material was predominantly nickel sulphate monohydrate ($NiSO_4.H_2O$) but it also contained sulphuric acid and water. The initial sulphuric acid and water content of the nickel sulphate containing material ranged between 10 and 20 wt %. The alkaline earth metal compound added in the examples was hydrated lime, or hydrated dolime or magnesium oxide, however, no free water was contained in the alkaline earth metal compound. Water was added to the above mixture to make a thick paste which was then extruded to form 3/16 of an inch sized slugs of about 2–3 inches long. The mixture of Example 5 was not extruded but cast in 3 inch diameter circular molds. It is noted that substantial heat was generated during mixing the ingredients and some water was lost by evaporation. The slugs hardened after about 12 to 24 hours. The results of these tests are shown in table 1.

TABLE 1

| Example | Acid Plant $NiSO_4$, wt % | Water added wt % | Alkaline earth metal compound added wt % | Extruded material after 12–24 hours | X-ray diffraction analysis |
|---|---|---|---|---|---|
| 1 | 91 | 9 | 0 | 3/16" slugs hard set | $NiSO_4.2\ H_2O$, $NiSO_4.6\ H_2O$ |
| 2 | 81 | 14 | hydrated lime 5 | 3/16" slugs hard set | $NiSO_4.2\ H_2O$ $NiSO_4.6\ H_2O$ $CaSO_4.2\ H_2O$ |
| 3 | 75 | 17 | hydrated dolime 8 | 3/16" slugs hard set | $NiSO_4.2\ H_2O$ $NiSO_4.6\ H_2O$ $CaSO_4.2\ H_2O$ |
| 4 | 76 | 16 | MgO 8 | 3/16" slugs hard set | $NiSO_4.2\ H_2O$ $NiSO_4.6\ H_2O$ |
| 5 | 90 | 10 | 0 | set hard in mold | $NiSO_4.2\ H_2O$ $NiSO_4.6\ H_2O$ |

The examples show that hard set agglomerates can be obtained by the present process. The agglomerating reaction may be recrystallization by hydration (examples 1 and 5), or precipitation of an insoluble alkaline earth metal sulphate together with recrystallization by hydration of the crystalline sulphates present in the mixture. It is assumed that magnesium sulphate heptahydrate was also formed as one of the agglomerating agents. However, the latter product was not shown by the X-ray diffraction analysis on account of it being a water soluble alkaline earth metal sulphate which is likely to go through an amorphous phase before complete crystallization.

Example 5 shows that the material will set hard in a mold without applying extrusion.

EXAMPLES 6–9

Copper and nickel containing fine metallics were mixed with agglomerating agents: acid plant nickel sulphate as described in examples 1–5, or a 40 wt % sulphuric acid solution, or commercially available fine plaster of paris containing predominantly calcium sulphate hemihydrate. The mixture was further mixed with water and additionally as shown in examples 7 and 8, with an alkaline earth metal compound such as hydrated dolime, to make a thick paste. The thick paste was extruded to form 3/16 inch sized slugs of 2–3 inch length. The slugs were found to set hard after about 12 to 24 hours. No crumbling was observed in drop tests. As noted previously, heat was generated during mixing and some water was lost by evaporation.

The X-ray diffraction analysis of the resulting slugs shows that the agglomerating reaction is recrystallization due to hydration in examples 6 and 9, and the formation of water soluble and water insoluble alkaline earth metal sulphate together with recrystallization by hydration in examples 7 and 8.

The experimental circumstances and the results of examples 6 to 9 are shown in table 2.

TABLE 2

| Example | Cu—Ni metallics, wt % | Sulphate source, wt % | Water added, wt % | Alkaline earth metal compound added, wt % | Extruded material after 12–24 hours | X-ray diffraction analysis |
|---|---|---|---|---|---|---|
| 6 | 77 | Acid Plant $NiSO_4$ 19 | 4 | 0 | 3/16 inch slugs set hard | $NiSO_4.2\ H_2O$ $NiSO_4.6\ H_2O$ |
| 7 | 80 | Acid Plant $NiSO_4$ 13 | 6 | Hydrated dolime 1 | 3/16 inch slugs set hard | $NiSO_4.2\ H_2O$ $NiSO_4.6\ H_2O$ $CaSO_4.H_2O$ |
| 8 | 72 | $H_2SO_4$ 48% strength 9 | 10 | Hydrated dolime 9 | 3/16 inch slugs set hard | $CaSO_4.2\ H_2O$ some $MgSO_4.7\ H_2O$ |
| 9 | 71 | Plaster of Paris 17 | 12 | 0 | 3/16 inch slugs set hard | $CaSO_4.2\ H_2O$ |

EXAMPLES 10 AND 11

Electrostatic precipitator dust obtained as a by-product and waste product of smelting and converting operations was to be agglomerated for recycling. The electrostatic precipitator dust was found to contain mainly copper, nickel and iron sulphates, sulphides and oxides. Fine particles of silica, oxides of alkali and alkaline earth metals and other volatile metal oxides were also found in the precipitator dust.

The electrostatic precipitator dust was mixed with water, and in addition with hydrated dolime in Example 11. The obtained thick paste was extruded to form ⅛ of an inch slugs having about 2–3 inch length. The slugs were allowed to harden in a period of 12–24 hours. The slugs were hard and did not crumble in drop tests.

The X-ray analyses of the agglomerated products indicate that the agglomerating reactions were the same as described in the previous examples, namely, recrystallization by hydration in Example 10, and recrystallization and precipitation in Example 11.

The conditions and results of Example 10 and Example 11 are set out in table 3.

TABLE 3

| Example | Metallurgical by-product wt % | Water added wt % | Alkaline earth metal compound added wt % | Extruded material after 12–24 hours | X-ray diffraction analysis |
|---|---|---|---|---|---|
| 10 | Electrostat. pptor dust 77 | 23 | 0 | 1/8 inch slugs hard set | $NiSO_4.2\ H_2O$ $NiSO_4.6\ H_2O$ |
| 11 | Electrostat. pptor dust 67 | 26 | Hydrated dolime 7 | 1/8 inch slugs hard set | $NiSO_4.2\ H_2O$ $NiSO_4.6\ H_2O$ $CaSO_4.2\ H_2O$ |

The foregoing description of the agglomeration process of the present invention and the Examples show that the agglomerated products are suitable for recycling metal sulphate containing products to metal extractive and similar processes.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

We claim:

1. A process for agglomerating metallurgical particles including loose, metal sulphate containing particles to render the metallurgical particles suitable as feedstock in a metal extractive process comprising mixing said metallurgical particles with water;

wherein said water is present in an amount to cause a substantial portion of said metal sulphate containing particles to react according to at least one reaction mechanism selected from the group consisting of hydration and precipitation of an alkaline earth metal sulphate, said alkaline earth metal selected from the group consisting of magnesium, calcium, strontium and barium, thereby yielding a hardenable agglomerate.

2. The process of claim 1 wherein said metallurgical particles are mixed with one or more of lime, slaked lime, dolime, hydrated dolime and burnt dolomite and said water is mixed with said metallurgical particles before, after or during said mixing one or more of lime, slaked lime, dolime, hydrated dolime and burnt dolomite.

3. The process of claim 2 wherein sulphuric acid is present in said mixture of metallurgical particles and water.

4. The process of claim 3 further including the step of adding sulphuric acid to said mixture of metal sulphate containing particles and water.

5. The process of claim 2 wherein said water is present in an amount of less than 20 wt % of the total weight of said metal sulphate containing particles and said lime, slaked lime, dolime, hydrated dolime and burnt dolomite.

6. The process of claim 2 wherein said mixture is extruded after said mixing and said water is present in said mixture in an amount such that water is not present in said mixture as a separate phase immediately before said extrusion.

7. The process of claim 6 wherein said metallurgical particles additionally include particles of metallurgical by-products which do not contain metal sulphate.

8. The process of claim 7 wherein said metallurgical by-products additionally included in said metallurgical particles, contain siliceous substances which also react with at least one of said lime, dolime and burnt dolomite, to yield a hardenable alkaline earth metal containing, silicate bearing agglomerate.

9. The process of claim 2 wherein said mixture of water and metallurgical particles is placed into a mold after mixing to form a hardened agglomerate.

10. The process of claim 2 wherein during said agglomeration, said metallurgical particles which comprise metal sulphate containing particles react with water according to at least one reaction selected from the group of reactions consisting of:

(a) hydration of a water soluble sulphate, (b) precipitation of a water insoluble alkaline earth metal sulphate, and (c) hydration of a water insoluble sulphate.

11. The process of claim 10 wherein the process for agglomerating further includes the step of reacting sulphuric acid with an alkaline earth metal base to yield an alkaline earth metal sulphate.

12. A process as claimed in claim 10, wherein said hydration of a water soluble sulphate comprises the reaction:

$$MSO_4.wH_2O+mH_2O \rightarrow MSO_4(w+m)H_2O$$

wherein both $MSO_4.wH_2O$ and $MSO_4.(w+m)H_2O$ are solid substances, M is a transition metal selected from the group consisting of Ni, Cu, Co. Cr, Ti, V and Fe, and wherein w has a value between 0 and 6, and m has a value between 1 and 7.

13. A process as claimed in claim 10, wherein said hydration of a water insoluble sulphate comprises the reaction:

$$ASO_4.cH_2O+dH_2O \rightarrow ASO_4.(c+d)H_2O,$$

wherein A is an alkaline earth metal selected from the group consisting of Ca, Sr and Ba and c has a value of 0 to 1 and d has a value of 0.5 to 2.

14. A process as claimed in claim 10, wherein said precipitation of a water insoluble alkaline earth metal sulphate comprises the reaction $$SO_4^{=}+A(OH)_2+2H^+ \rightarrow ASO_4+2H_2O$$

wherein A is selected from the group consisting of Ca, Sr and Ba.

15. A process as claimed in claim 10 wherein said agglomeration further includes neutralization of an alkaline earth metal base by sulphuric acid to yield an alkaline earth metal sulphate.

16. The process of claim 15 wherein the alkaline earth metal base is selected from the group consisting of CaO, $Ca(OH)_2$, MgO and $Mg(OH)_2$.

17. A process of claim 2, wherein said lime contains at least one compound selected from the group consisting of calcium oxide, slaked lime and hydrated lime.

18. A process of claim 2, wherein said dolime contains at least lime and one compound selected from the group consisting of magnesium oxide and hydrated magnesium oxide.

19. The process of claim 1 wherein sulphuric acid is present in said mixture of metallurgical particles and water.

20. The process of claim 1 wherein said mixture is extruded after said mixing and said water is present in said mixture in an amount such that water is not present in said mixture as a separate phase immediately before said extrusion.

21. The process of claim 1 wherein said mixture of water and metallurgical particles is placed into a mold after mixing to form a hardened agglomerate.

22. A process for agglomerating metallurgical particles, said particles including loose, metal sulphate containing particles to render the metallurgical particles suitable as feedstock in a metal extractive process, comprising (a) dissolving a portion of the metal sulphate in water such that water is not present as a separate phase, (b) adding one or more of lime, dolomitic lime and burnt dolomite in a concentration sufficient to precipitate calcium sulphate, and (c) extracting the mixture so obtained into agglomerates and allowing the agglomerates to become hard and shape retentive thereby rendering the metallurgical particles suitable as feedstock in a metal extractive process.

23. A process as claimed in claim 22 wherein the metal sulphate containing particles contain one or more of ferrous sulphate, ferric sulphate, nickel sulphate, copper sulphate, tin sulphate, chromium sulphate, manganese sulphate, zinc sulphate, cobalt sulphate, aluminium sulphate, titanium sulphate and silver sulphate.

24. The process of claim 22 wherein the metal sulphate is present in the metallurgical particles in an amount sufficient to agglomerate said particles after said extrusion.

25. A process as claimed in claim 22, wherein the metallurgical particles are combined with one or more of lime, dolomitic lime and burnt dolomite and water is then added to the mixture.

26. A process as claimed in claim 22, wherein the water is added to the metallurgical particles and the metallurgical particles are reacted with one or more of lime, dolomitic lime and burnt dolomite.

27. A process as claimed in claim 22, wherein the metallurgical particles additionally contain metal oxides and the agglomerates contain metal oxides.

28. A process as claimed in claim 22 wherein the metallurgical particles contain a by-product of a metallurgical operation or process.

29. A process as claimed in claim 22 wherein the metallurgical particles comprise one or more of:

a sediment or slime obtained from an electrolytic refining process, dust collected by electrostatic precipitators resulting from reaction of sulphurous gases with fine particles of oxides carried by exhaust gases, fumes or waste-products of photographic processes or processes which utilize metal or metal oxides as catalysts, residues of a leaching process, and particles obtained from the treatment of metals or metal compounds with sulphuric acid resulting from metal sulphate formation.

30. The process of claim 22 wherein prior to dissolving said metal sulphates in water, said metallurgical particles are mixed with fine cementitious silicate containing particles selected from the group consisting of silicate containing fumes, silicate containing calcined dust, portland cement, flyash and slag cement.

31. The process of claim 30 wherein said mixture of metallurgical particles, water and one or more of lime, dolomitic lime and burnt dolomite is further admixed with a hydrocarbonaceous substance having melting point higher than 140° F. prior to being extruded as agglomerates.

32. The process of claim 22 wherein said metallurgical particles comprise compounds containing one or more of nickel, copper, cobalt, silver, chromium and/or zinc.

* * * * *